US005092025A

United States Patent [19]

Harrington

[11] Patent Number: 5,092,025

[45] Date of Patent: Mar. 3, 1992

[54] CLOSET SPUD TOOL

[76] Inventor: Robert E. Harrington, 5708 Ranger St., Virginia Beach, Va. 23464

[21] Appl. No.: 201,793

[22] Filed: Jun. 3, 1988

[51] Int. Cl.[5] ..... B21D 39/00

[52] U.S. Cl. ..... 29/522.1; 29/525; 29/278; 81/176.15

[58] Field of Search ..... 81/13, 176.1, 176.15, 81/176.2, 125.1, 124.4, 436–439, 15.7, 15.5; 29/278, 280, 282, 522.1, 523, 525, 451, 235; 4/DIG. 9, 255; 285/38–39

[56] References Cited

U.S. PATENT DOCUMENTS

| | | | |
|---|---|---|---|
| 2,644,359 | 7/1953 | Lydle | 81/124.4 |
| 3,156,141 | 11/1964 | Pluntz | 81/176.15 X |
| 4,016,696 | 4/1977 | Mess et al. | 29/278 X |

FOREIGN PATENT DOCUMENTS

| | | | |
|---|---|---|---|
| 157750 | 1/1953 | Australia | 81/176.15 |

*Primary Examiner*—D. S. Meislin

*Attorney, Agent, or Firm*—Sughrue, Mion, Zinn, Macpeck & Seas

[57] ABSTRACT

A four-way closet spud insertion tool for inserting a spud into a inlet/outlet hole of a plumbing fixture. The closet spud includes a couple having at least one lug protruding inwardly therefrom and a gasket circumscribing the couple, the gasket having a flared portion that is to be inserted into the inlet/outlet hole of the fixture with a portion of the couple, the diameter of the flared portion being greater than the diameter of the hole. The spud insertion tool comprises a cross-shaped body having four arms extending from a center point thereof, each of the arms terminating in a different head, each of the heads being configured to be insertable into a respectively sized couple, the force being sufficient to compress the flared portion of the gasket such that the flared portion can pass through the hole of the fixture.

9 Claims, 3 Drawing Sheets

CLOSET SPUD TOOL

BACKGROUND OF THE INVENTION

1. Field of the Invention

The invention relates to the installation of closet spuds in plumbing fixtures such as water closets and urinals.

2. Background

Closet spuds are used for connecting water supply and discharge lines to the inlet and outlet holes, respectively, of plumbing fixtures. The closet spud includes a couple having a flared portion at one end thereof, a rubber gasket circumscribing the flared portion and having a corresponding flared portion, a friction ring abutting the rubber gasket and a coupling nut threaded on the threaded portion of the other end of the couple.

To install the closet spud in the fixture the flared portion of the couple and gasket are inserted into the inlet/outlet hole of the fixture. Subsequent thereto, the coupling nut is tightened on the couple to cause the flared portion of the gasket to expand against the perimeter of the hole.

Those who install closet spuds find it convenient to insert the spud into the inlet/outlet hole of the fixture in a semi-expanded condition where the outside diameter of the flared portion of the rubber gasket is larger than the diameter of the inlet/outlet hole of the plumbing fixture. Therefore, the spud must be press-fitted into the hole of the plumbing fixture. After the spud is inserted, the coupling nut is securely tightened relative to the couple to provide a tight seal between the spud and the inlet.

Conventionally, the closet spud is inserted into the inlet/outlet hole of the fixture by hand. However, due to the manner in which the spud is press-fitted into the hole of the fixture, it is extremely difficult to insert the spud using only one's hands. Specifically, it is difficult to apply a sufficient and uniform force against the periphery of the spud such that the rubber gasket is uniformly compressed to permit the flared portion of the gasket to pass through the hole of the fixture. Hand insertion generally results in the application of a non-uniform force causing the spud to become misaligned relative to the hole. In many instances this results in cracking of the extremely brittle fixture. There is no known device for uniformly inserting the spud into the inlet of a plumbing fixture so as to overcome the disadvantage discussed above.

The only known device which is pertinent to the installation of a spud is a device for tightening the coupling nut after the spud has been inserted into the inlet of the fixture by hand. Such a device is disclosed in Pluntz, U.S. Pat. No. 3,156,141. As shown in FIG. 1 the Pluntz device includes a block 2 for holding the couple A of the spud while a ratchet device 5 rotates the coupling nut D relative thereto to secure the spud in the inlet/outlet hole of the fixture.

As the Pluntz device is rather large and cumbersome, it is designed solely for tightening the spud subsequent to the insertion thereof. The spud device is not designed for inserting the spud into the hole of the fixture.

Accordingly, the internal closet spud insertion wrench of the present invention fills the void in the art of spud installation.

SUMMARY OF THE INVENTION

It is an object of this invention to provide a closet spud insertion tool.

It is further an object to provide a closet spud insertion tool which allows for accurate insertion of the spud into a fixture without destruction thereof.

A further object is to provide a closet spud insertion tool which can also be used to secure the spud in the inlet/outlet hole of the fixture subsequent to insertion thereof.

Yet another object is to provide a closet spud insertion tool which is compact and transportable.

Still another object is to provide a compact closet spud insertion tool which can be used to insert various standard size spuds.

These and other objects, which will become apparent from the ensuing description of the preferred embodiments of the invention, are accomplished according to the present invention by an internal closet spud insertion tool for inserting a spud into a inlet/outlet hole of a fixture, in which a spud includes a couple having at least one lug protruding inwardly therefrom and a gasket circumscribing the couple, the gasket having a flared portion that is to be inserted into the inlet/outlet hole of the fixture with a portion of the couple, the diameter of the flared portion being greater than the diameter of the hole, the spud insertion tool comprising a body having at least three arms extending from a center point thereof at least one of said arms terminating in a head configured to be insertable into a respectively sized couple, whereby a force sufficient to uniformly compress the flared portion of the gasket such that the flared portion can pass through the hole of the fixture can be conveniently applied to the couple. Additionally, each arm may terminate in a head of a different size, each head being configured to be insertable into a respectively sized couple.

The three arm body may be "T" shaped. Alternatively, a cross shaped body having four arms may be provided in which case a different head each being configured to be insertable into a respectively sized couple, may be fixed to each arm.

Each of the heads is cylindrical in shape, the diameter for each head being different. Each of the heads has at least one recess in the outer periphery thereof for engaging with the lug of the couple.

DESCRIPTION OF THE PREFERRED EMBODIMENT

Figure 1A:
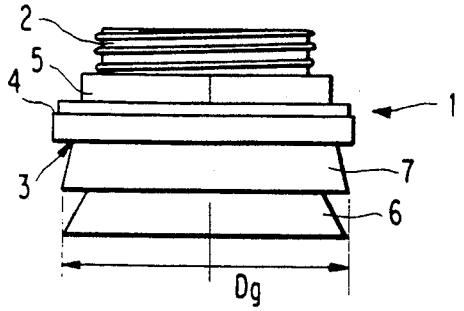
FIG. 1*a* and 1*b* are side and front views, respectively, of a conventional closet spud.
Figure 1B:
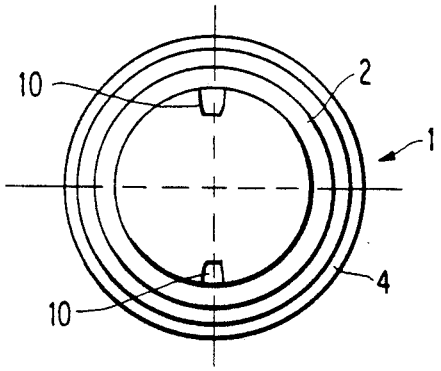
Figure 4:
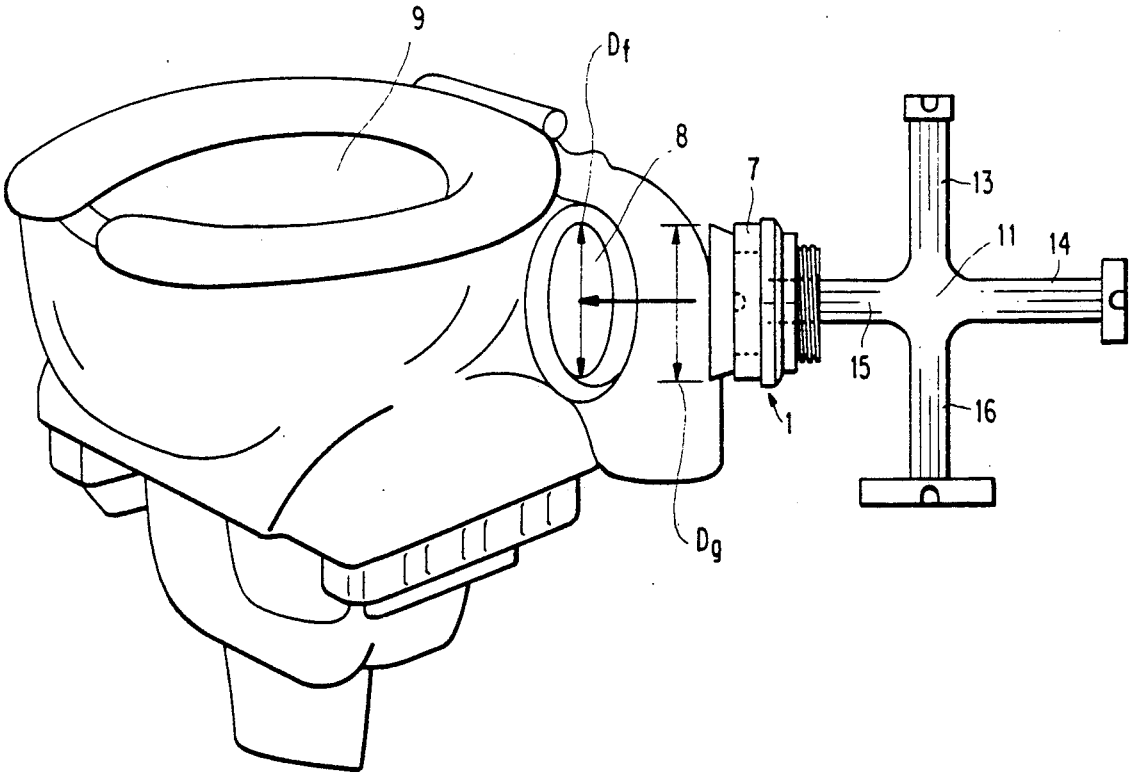
FIG. 4 is a perspective view showing the closet spud being inserted into an inlet hole of a toilet using the spud-insertion tool of the subject invention.

FIGS. 1*a* and 1*b* show a conventional closet spud, the insertion of which the four-way internal spud insertion tool of the present invention is designed to facilitate. The conventional closet spud 1 includes a couple 2, a rubber gasket 3, a friction ring 4, and a coupling nut 5, as shown in FIG. 1*a*. The couple 2 is externally threaded at one end and is flared at the other end thereof to form a substantially conical flange 6. The gasket 3 circumscribes the couple 2 and comprises a flared portion 7 which corresponds to the conical flange 6 of the couple 2. As shown in FIGS. 1*a*, 1*b* and 4, the outer diameter $D_g$ of the flared portion 7 of the gasket 3 is larger than the diameter $D_f$ of the inlet hole 8 of the fixture 9.

The coupling nut 5 is threadedly engaged with the couple 2 and is in abutting relationship with a circumferential portion of the gasket 3, the friction ring 4 being disposed therebetween. The couple 2 includes opposing lugs 10, shown in FIG. 1*b*, extending inwardly therefrom, the lugs 10 being spaced 180 degrees apart. Such an arrangement is standard on substantially all closet spuds. However, for some smaller diameter spuds there is only a single lug provided in the interior of the couple.

Figure 2:
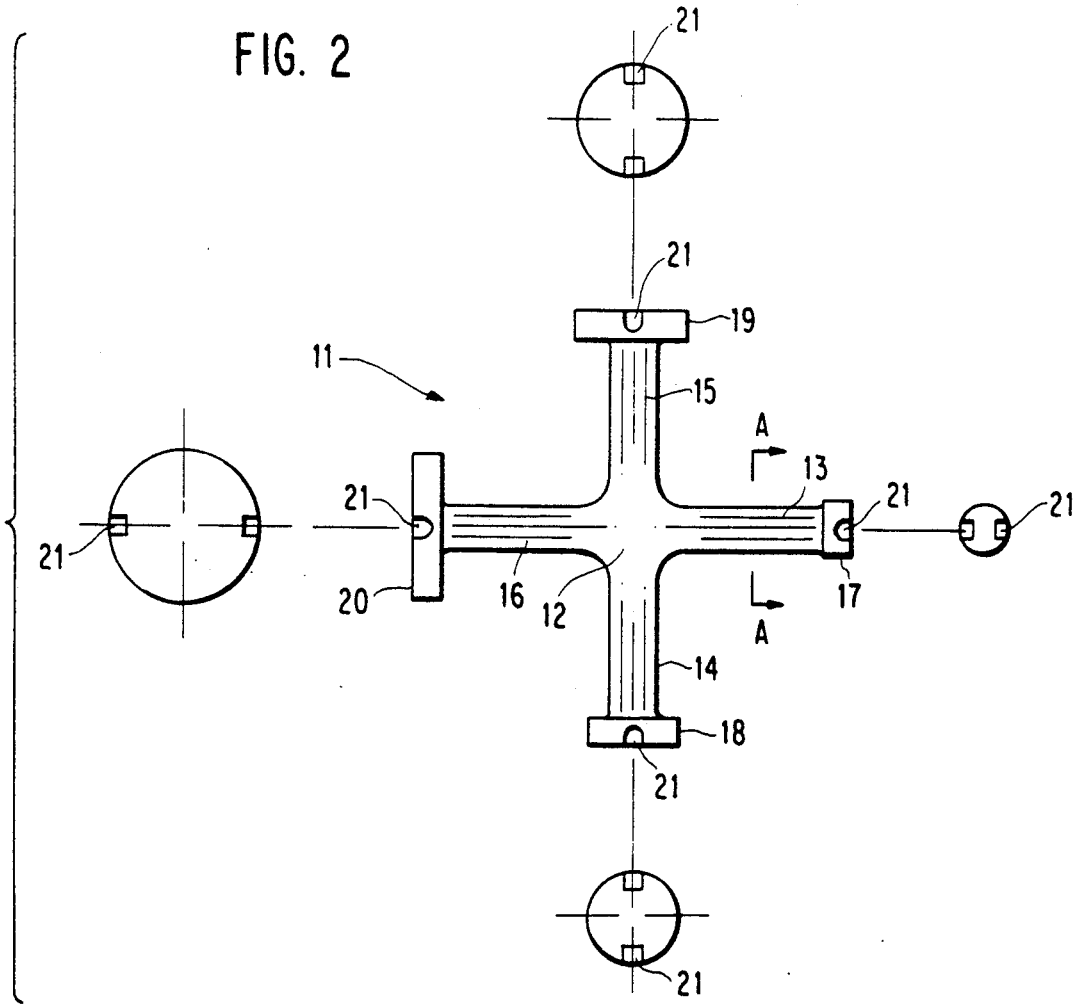
FIG. 2 is a front view of the four-way closet stud insertion tool of the present invention.

As shown in FIG. 2, the novel stud insertion wrench 11 includes a cross-shaped body 12 having arms 13, 14 15 and 16 extending from a center point thereof. Each arm 13 14, 15 and 16 terminates in a respective head 17, 18, 19 and 20. The heads are cylindrical in shape. The diameter of each of the heads is different from one another, the diameter of head 17 being the smallest and the diameter of heads 18, 19 and 20 increasing in that order. The head diameters correspond to the internal diameter of the couple in the most commonly used closet spuds. Thus, the spud insertion tool, according to the subject invention, can be used to insert closet spuds of different sizes.

Each of the heads includes opposing recesses 21 formed on the periphery thereof the recesses 21 being configured to correspond to the configuration of the lugs 10 disposed on the couple 2 of the spud 1. While each of the heads is illustrated to have two recesses, it is understood that any number to recesses may be provided to correspond with the number of lugs provided in the couple of the stud. Thus, for example, the smallest diameter head 17 may include only one recess if the spud has only one lug.

Figure 3A:
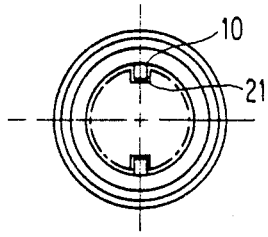
FIG. 3*a* and 3*b* front and side views, respectively of the closet spud insertion tool of the subject invention in engagement with the closet spud.
Figure 3B:
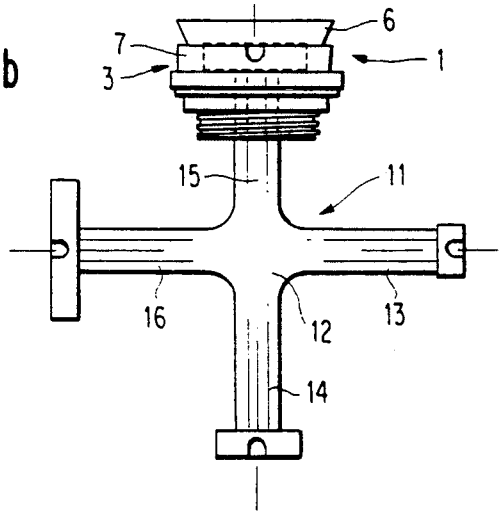

The insertion procedure of the spud 1 into the inlet/-outlet hole 8 of the fixture 9 using the four-way insertion tool 11, according to the subject invention, will be described with reference to FIGS. 3 and 4. Referring to FIG. 3, after completing the selection of the proper head diameter corresponding to the respectively sized stud, the closet spud 1 is positioned on the selected head with the conical flange 6 of the closet spud opposing the center of the cross-shaped base 12. The tool is then rotated relative to the closet spud until the lugs 10 of the spud 1 engage the recesses 21 in the head of the tool.

With the closet spud 1 in the engaged position on the tool 11, the closet spud is positioned, as shown in FIG. 4, in preparation for the insertion of the closet spud into the inlet/outlet hole 8 of the fixture 9. As stated hereinbefore, the diameter $D_f$ of the hole 8 of the fixture 9 is smaller than the diameter $D_g$ of the flared portion 7 of the gasket to be inserted therein. Due to the diametrical interference the spud 1 must be press-fitted into the hole 8 of the fixture 9. Therefore a uniform and sufficient force must be applied to accurately insert the spud 1 into the hole 8 of the fixture 9 and thereby avoid accidental destruction of the same.

Hand insertion of the spud is difficult for the following reasons. Due to the relatively small size of the spud, as compared to one's hand, the spud cannot be securely grasped to apply the necessary force required by the press-fit between the gasket and the inlet. Moreover, a uniform force can not be applied along the circumference of the spud as required to uniformly compress the flanged portion of the gasket for insertion.

The four-way internal insertion spud tool of the subject invention permits the application of a strong insertion force to the spud in a uniform manner. Particularly referring to FIG. 3 for example, the spud insertion tool is designed to permit the user to grasp the arms 13, 16 disposed perpendicular to the selected insertion arm 15. By gripping the tool in this fashion, the user can achieve the leverage necessary to apply the required inserting force.

In addition, the spud insertion tool contacts the spud at opposing peripheral portions thereof. Therefore, the force is equally applied to opposing sides of the spud. The symmetrically applied forces are transmitted to the couple to thereby create a uniform pressure over the circumference of the gasket 3. Accordingly, a sufficient uniformly applied force is generated so as to symmetrically compress the flared insertion portion 7 of the gasket 3 to a diameter less than the diameter of the hole 8 of the fixture 9. Such an arrangement allows for easy and accurate spud insertion without causing accidental damage to the plumbing fixture.

Subsequent to the insertion of the spud into the inlet of the fixture the spud tool of the subject invention is used to secure the spud 1 in the hole 8 of the fixture 9 to create a tight seal. Particularly, with the tool 11 positioned in engaging contact with the couple 2, in the manner described above, the coupling nut 5 is tightened relative to the couple 2 causing the flared portion 7 of the gasket 3 to expand diametrically in sealing contact with the perimeter of the hole of the fixture.

Figure 5:
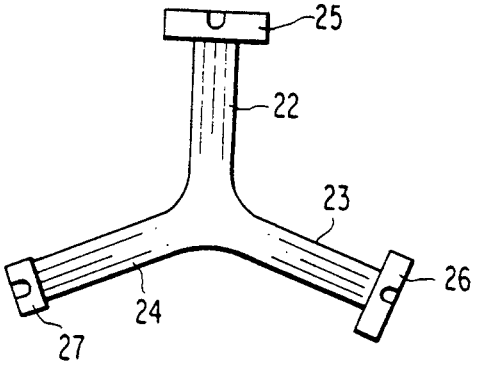
FIG. 5 is a front view of a three arm closet stud insertion tool according to another embodiment of the invention.

According to another embodiment of the invention as shown in FIG. 5 the spud insertion tool includes three arms 22 23 and 24 extending from a center point thereof. Each arm 22, 23 and 24 terminates in a respective head 25, 26 and 27 having a cylindrical shape. The head diameters are differently sized to correspond to respectively sized closet spuds. To insert the closet spud using the three arm tool, the user first selects the proper insertion arm and grasps the other two arms to thereby apply a uniform insertion force to the spud through the insertion head.

Figure 6:
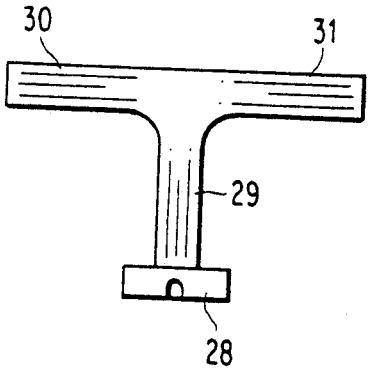
FIG. 6 is a front view of a "T" shaped three arm closet spud insertion tool according to a further feature of the invention.

FIG. 6 illustrates still a further embodiment of the invention in which the three arm tool is "T" shaped. The "T" shape tool includes a single head 28 disposed at the end of arm 29. To insert the closet spud using the "T" shaped tool the user grasps the other arms 30 and 31 to exert the necessary uniform insertion force through head 28.

Although the present invention describes the preferred embodiments of the invention, it should be understood that numerous structural modifications and adaptations may be resorted to without departing from the spirit of the invention. For example, as discussed above, the number of recesses provided in each head can vary to correspond to the number of lugs in the spud to be inserted.

Accordingly, the present invention fills a void in the field of toilet spuds. While toilet spuds have conventionally been inserted into the inlets/outlets of plumbing fixtures by hand resulting in accidental damage to plumbing fixtures, toilet spuds may now be safely and accurately inserted using the spud insertion tool of the subject invention. Furthermore, the closet spud insertion tool can be used to hold the couple while the coupling nut is tightened, thus providing a dual function.

What is claimed is:

1. A closet spud insertion tool for inserting and securing a spud in hole of a fixture, said spud including a tubular shaped couple having a through hole of a predetermined diameter and at least one lug protruding inwardly into said through hole and a gasket circumscribing said couple, said gasket having a flared portion to be inserted into said hole of said fixture with a portion of said couple, the diameter of said flared portion being greater than the diameter of said hole requiring that said couple be forcibly inserted into said hole, said spud insertion tool comprising:

a body having three arms extending from a center point thereof, at least one of said arms terminating in a head, said head being a solid head cylindrical in shape, the diameter of said head being slightly smaller than said predetermined diameter of said couple, said head having at least one recess in the outer periphery thereof so that said head is insertable into and engageable with said couple to apply a substantially uniform force in the axial direction of said hole against said couple when a force is applied to two other arms of said body, said force being sufficient to compress said flared portion of said gasket such that said flared portion of said gasket can pass through said hole of said fixture.

2. The spud insertion tool according to claim 1, wherein each of said arms terminates in a different head.

3. The spud insertion tool according to claim 1, wherein said body is T-shaped.

4. The spud insertion tool according to claim 3, wherein said T-shaped body further includes a fourth arm opposing said at least one arm to form a substantially cross-shaped body, wherein each of said arms terminates in a different head, each of said heads being configured to be insertable into a respectively sized couple.

5. The spud insertion tool according to claim 4, wherein the diameter of each of said heads is different for each head.

6. A closet spud insertion tool for inserting and securing a spud in a hole of a fixture, said spud including a tubular shaped couple having a through hole of a predetermined diameter and at least one lug protruding inwardly into said through hole and a gasket circumscribing said couple, said gasket having a flared portion to be inserted into said hole of said fixture with a portion of said couple, the diameter of said flared portion being greater than the diameter of said hole requiring that said couple be forcibly inserted into said hole, said spud insertion tool comprising:

a cross-shaped body having four arms extending from a center point thereof, each of said arms terminating in a different head, each of said heads being a solid head cylindrical in shape, the diameter of said head being slightly smaller than said predetermined diameter of said couple, said head having at least one recess in the outer periphery thereof so that said head is insertable into and engageable with said couple to apply a substantially uniform force in the axial direction of said hole against said couple, said force being sufficient to compress said flared portion of said gasket such that said flared portion of said gasket can pass through said hole of said fixture.

7. The spud insertion tool according to claim 6, wherein the diameter of each of said heads is different for each head.

8. A method for inserting and securing a closet spud in a hole of a fixture using a closed spud insertion tool, said spud including a couple having at least one lug protruding inwardly therefrom, a coupling nut threadedly engaged with said couple and a gasket circumscribing said couple, said gasket having a flared portion to be inserted into said hole of said fixture with a portion of said couple, the diameter of said flared portion being greater than the diameter of said hole, wherein said tool includes a body having at least three arms extending from a center point thereof, at least one of said arms terminating in a head, said head being configured to be insertable into a respectively sized couple and having at least one recess in the outer periphery thereof, the method comprising the steps of, positioning said spud onto said head at the end of said at least one arm;

rotating said spud relative to said head such that said at least one recess engages said at least one lug;

holding said tool by grasping two other arms such that a uniform force can be applied to said spud through said head; and inserting said spud into said hole by applying said uniform force thereon so as to compress the flared portion of said gasket such that said flared portion of said gasket can pass through said hole of said fixture.

9. The method according to claim 8, further comprising the steps of:

holding said couple of said stud with said tool subsequent to the insertion of said stud into said hole; and rotating said coupling nut relative to said couple such that said flared portion of said gasket expands in sealing contact with the perimeter of said hole.

* * * * *